US009990819B2

(12) United States Patent
Ricks et al.

(10) Patent No.: US 9,990,819 B2
(45) Date of Patent: Jun. 5, 2018

(54) MAGNETIC HINGE SENSOR FOR BARRIER

(71) Applicant: Vivint, Inc., Provo, UT (US)

(72) Inventors: Sean Ricks, American Fork, UT (US); Jeremy B. Warren, Draper, UT (US)

(73) Assignee: Vivint, Inc., Provo, UT (US)

( * ) Notice: Subject to any disclaimer, the term of this patent is extended or adjusted under 35 U.S.C. 154(b) by 0 days. days.

(21) Appl. No.: 15/371,034

(22) Filed: Dec. 6, 2016

(65) Prior Publication Data

US 2017/0084144 A1 Mar. 23, 2017

Related U.S. Application Data

(63) Continuation-in-part of application No. 15/155,069, filed on May 15, 2016, now Pat. No. 9,652,950, which is a continuation of application No. 14/490,041, filed on Sep. 18, 2014, now Pat. No. 9,366,065.

(51) Int. Cl.

| | |
|---|---|
| ***G08B 13/08*** | (2006.01) |
| ***E05D 3/02*** | (2006.01) |
| ***E05D 11/00*** | (2006.01) |
| ***G08B 25/10*** | (2006.01) |

(52) U.S. Cl.

CPC ..... *G08B 13/08* (2013.01); *E05D 3/02* (2013.01); *E05D 11/00* (2013.01); *G08B 25/10* (2013.01); *E05Y 2400/32* (2013.01); *E05Y 2400/44* (2013.01); *E05Y 2400/66* (2013.01); *E05Y 2600/40* (2013.01); *E05Y 2800/00* (2013.01); *E05Y 2900/132* (2013.01)

(58) Field of Classification Search

CPC ..... E05D 11/00; E05Y 2900/132

USPC ..... 340/545.1, 545.2, 547, 545.6, 545.7, 340/545.8, 545.9, 565, 541, 567; 33/194

See application file for complete search history.

(56) References Cited

U.S. PATENT DOCUMENTS

| | | | | |
|---|---|---|---|---|
| 6,975,224 | B2 * | 12/2005 | Galley, III | B65D 90/00 340/10.1 |
| 7,122,944 | B2 * | 10/2006 | Grimshaw | G08B 13/08 310/338 |
| 7,330,007 | B2 | 2/2008 | Sugiura et al. | |
| 7,610,684 | B2 * | 11/2009 | Steinich | E05D 11/00 33/1 PT |

(Continued)

FOREIGN PATENT DOCUMENTS

| | | | |
|---|---|---|---|
| WO | 2014102705 | A1 | 7/2014 |

OTHER PUBLICATIONS

PCT International Search Report for International Application No. PCT/US2015/048028, dated Nov. 12, 2015 (3 pp.).

(Continued)

*Primary Examiner* — Toan N Pham

(74) *Attorney, Agent, or Firm* — Holland & Hart LLP

(57) ABSTRACT

Methods and systems are described for determining operation of an openable barrier into a building. A method for determining an open state of a barrier may include identifying a first position for the barrier, the barrier having at least one hinge and a hinge sensor magnetically mounted to the at least one hinge. The method may further include determining, based at least in part on the hinge sensor, when the barrier changes position from the first position to a second position. The method may further include wirelessly transmitting data concerning the change in position of the barrier.

21 Claims, 13 Drawing Sheets

(56) References Cited

U.S. PATENT DOCUMENTS

| | | | | |
|---|---|---|---|---|
| 7,916,018 | B2 | 3/2011 | Eskildsen et al. | |
| 8,764,071 | B2 | 7/2014 | Lanigan et al. | |
| 8,786,435 | B2 * | 7/2014 | Barnett | H05B 37/0272 340/506 |
| 2004/0046401 | A1 | 3/2004 | Watanabe | |
| 2005/0064914 | A1 | 3/2005 | Gough | |
| 2006/0038673 | A1 | 2/2006 | Chapman | |
| 2008/0303655 | A1 | 12/2008 | Johnson | |
| 2010/0194563 | A1 | 8/2010 | Berner et al. | |
| 2010/0223853 | A1 | 9/2010 | Wayman et al. | |
| 2013/0081329 | A1 | 4/2013 | French et al. | |
| 2015/0040215 | A1 * | 2/2015 | Blodgett | G06F 21/85 726/22 |
| 2017/0260783 | A1 | 9/2017 | Crolley | |

OTHER PUBLICATIONS

PCT International Search Report for International Application No. PCT/US2016/026952, dated Jul. 20, 2016 (3 pp.).

* cited by examiner

MAGNETIC HINGE SENSOR FOR BARRIER

RELATED APPLICATIONS

The present application is a continuation-in-part of U.S. patent application Ser. No. 15/155,069, titled: "Hinge Sensor for Barrier," filed on May 15, 2016, which is a continuation of U.S. patent application Ser. No. 14/490,041, titled: "Hinge Sensor for Barrier," filed on Sep. 18, 2014, now U.S. Pat. No. 9,366,065, issued on Jun. 14, 2016, the disclosures of which are incorporated, in their entireties, by this reference.

BACKGROUND

Advancements in media delivery systems and media-related technologies continue to increase at a rapid pace. Increasing demand for media has influenced the advances made to media-related technologies. Computer systems have increasingly become an integral part of the media-related technologies. Computer systems may be used to carry out several media-related functions. The wide-spread access to media has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the wide-spread use of computers and mobile devices has come an increased presence of home/business automation and security products. Advancements in mobile devices allow users to monitor and/or control an aspect of a home or business. As automation and security products expand to encompass other systems and functionality in the home and/or businesses, opportunities exist for more accurately monitoring a property and providing functionality in response.

SUMMARY

Methods and systems are described for determining operation of an openable barrier into a building. According to at least one embodiment, a method for determining an open state of a barrier includes identifying a first position for the barrier, the barrier having at least one hinge and a hinge sensor magnetically mounted to the at least one hinge; determining, based at least in part on the hinge sensor, when the barrier changes position from the first position to a second position; and wirelessly transmitting data concerning the change in position of the barrier.

In one example, the method may further include determining movement of the barrier with a motion sensor.

In one example, the hinge sensor may include a fixed portion, and the method may include fixing a position of the fixed portion relative to the at least one hinge, determining with the hinge sensor when the barrier is in a closed position, and detecting with the hinge sensor when the barrier changes position from the closed position. In some embodiments, the fixed portion of the hinge sensor may include a spring-loaded sensor.

In one example, the hinge sensor may include a rotatable portion and a fixed portion, and the method may include fixing a position of the fixed portion relative to the at least one hinge, and rotatably mounting the rotatable portion to the fixed portion, the rotatable portion being arranged in contact with and movable by the barrier. In some examples, the hinge sensor may include a motion sensor that is mounted to the fixed portion. In some examples, the method may include determining with the motion sensor when an object moves through an opening that is controlled by the barrier.

In some examples, the first position may be a closed position, and the second position may be an open position. In other examples, the first position may be a first open position, and the second position may be a second open position. In any embodiment, the method may include determining at least one of the first and second positions.

Another embodiment is directed to a sensor assembly for use with a barrier. The sensor assembly may include a fixed portion configured to maintain a fixed position relative to a hinge of the barrier to which the sensor assembly is magnetically mounted, and a rotatable portion pivotally connected to the fixed portion and arranged to contact the barrier. The sensor assembly may be operable to determine a position of the barrier based on at least one of a relative position between the fixed and rotatable portions and a change in position of the rotatable portion.

The sensor assembly may include a battery power source. The sensor assembly may include a wireless transmitter configured to transmit data concerning the sensed position of the barrier. The sensor assembly may be operable to determine an amount the barrier is open relative to a closed position.

A further embodiment is directed to a barrier position detecting apparatus. The apparatus may include a mounting portion configured to releaseably magnetically mount a sensor assembly to a hinge of a barrier, a fixed portion configured to maintain a fixed position relative to the hinge, a movable portion arranged to contact the barrier at least when the barrier moves, the movable portion being movable relative to the fixed portion, and a transmitter configured to wirelessly transfer data about a position of the barrier based on at least one of a relative position between the fixed and movable portions and a change in position of the movable portion.

The movable portion may be biased into contact with the barrier. The apparatus may also include at least one motion sensor. The at least one motion sensor may include a passive infrared sensor. The apparatus may include a potentiometer configured to determine a rotated position of the movable portion relative to the fixed portion. The apparatus may include a piezoelectric sensor configured to measure an electrical charge generated from a force applied to the movable portion by the barrier when the barrier moves.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
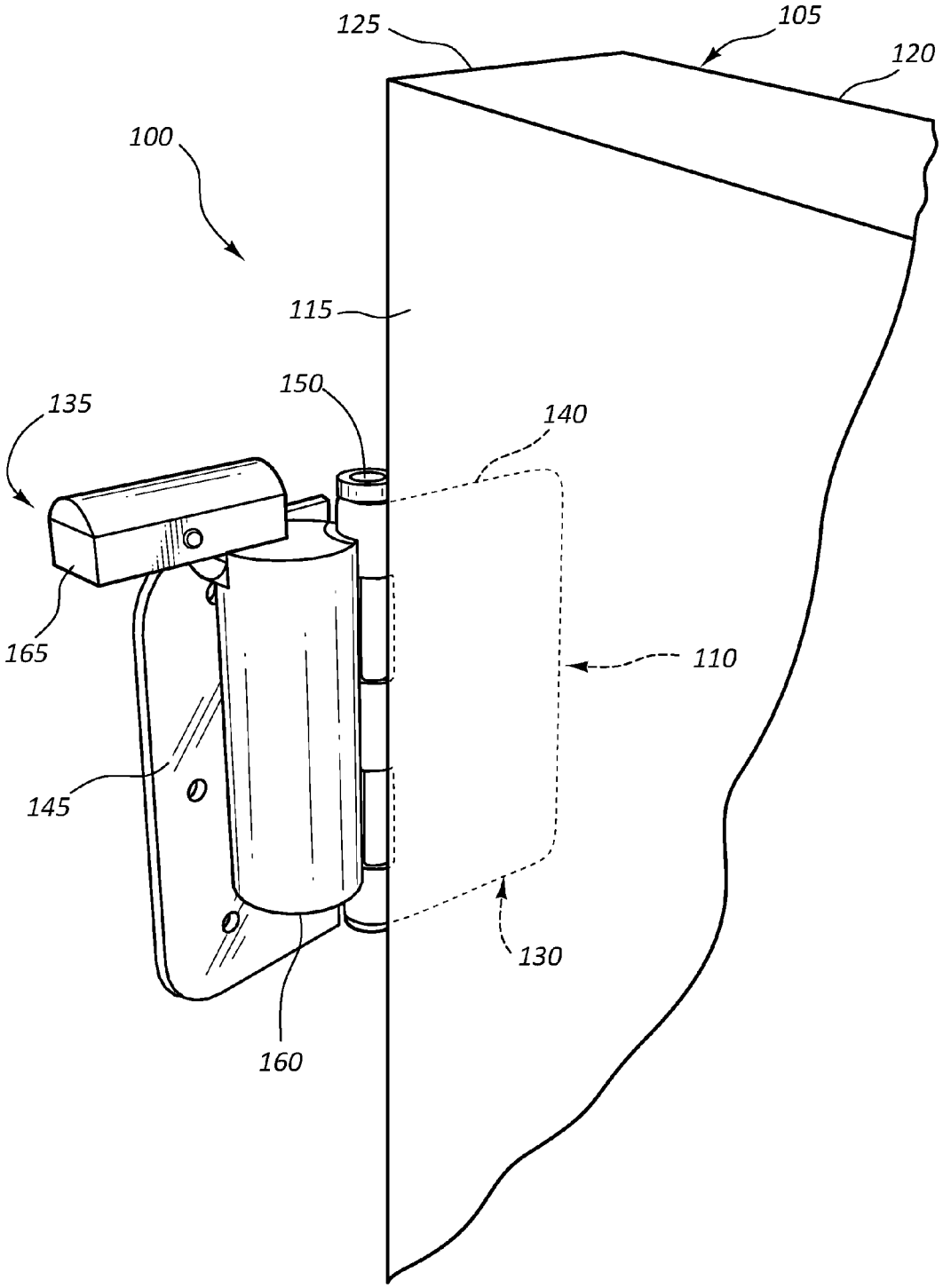
FIG. 1 is perspective view of a door assembly having a door and a magnetic hinge assembly in which the systems and methods disclosed herein may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The systems and methods described herein relate to home automation and home security, and related security systems and automation for use in commercial and business settings. As used herein, the phrase "home automation system" may refer to a system that includes automation features alone, security features alone, a combination of automation and security features, or a combination of automation, security and other features. While the phrase "home automation system" is used throughout to describe a system or components of a system or environment in which aspects of the present disclosure are described, such an automation system and its related features (whether automation and/or security features) may be generally applicable to other properties such as businesses and commercial properties as well as systems that are used in indoor and outdoor settings.

The systems and methods described herein relate generally to monitoring operation and/or movement of a barrier, such as a door or window. Among other functions, home automation systems typically monitor and control access through barriers such as doors and windows. There are number of challenges related to determining if operation of or entry through a barrier is authorized. Data related to operation of a barrier may be used for a variety of purposes. For example, determining whether operation of or entry through a barrier is authorized may influence whether 1) an alarm is avoided when an authorized person operates or passes through a barrier, or 2) an alarm is properly generated when an unauthorized person operates or passes through the barrier.

One aspect of the present disclosure relates to systems, methods and related devices for determining whether a door, window or other barrier is operated, such as when a person enters or exists a building. One or more sensors may be used to determine such access. For example, one or more hinge sensors may be magnetically mounted to a hinge of the barrier. The hinge sensors may determine movement of the barrier (e.g., movement from a closed position to an open position, or movement from one open position to another open position). The hinge sensors may include, for example, a potentiometer, an electrostatic sensor, a piezoelectric sensor, or a magnetic sensor.

Additionally, another sensor, such as a motion sensor, may be used to confirm that the barrier is moved and/or that an object, such as a person, has moved through the opening (e.g., doorway) associated with the barrier. The additional sensor may be positioned at a location spaced apart from the hinge sensor (e.g., at location remote from the hinge sensor but within a room to which the barrier provides access). Additionally, or alternatively, the additional sensor may be carried in the same housing as the hinge sensor. The additional sensor may be a different type of sensor than the type of sensor used for the hinge sensor.

The hinge sensor may be integrated into a single housing. The hinge sensor may be magnetically mounted directly to a hinge of the barrier, such that the hinge sensor couples to the vertical outer portion of the hinge, with a concave curvature of the hinge sensor being complementary to the convex curvature of the vertical outer portion of the hinge. A portion of the hinge sensor may contact the barrier prior to and/or during opening of the barrier. The hinge sensor may include a transmitter and/or a transceiver that wirelessly communicates with a monitoring system, such as a home automation system.

The ability to determine whether the barrier is open or closed and/or whether a person or object passes through a barrier may be one of many factors used to determine use of a building (whether authorized or unauthorized) and/or a pattern of behavior for at least some users of the building. The opening and/or closing function may be associated with a particular person. For example, a person may carry a device that identifies who he/she is (e.g., authentication), and associates the barrier opening with that person. The device may be a cell phone, fob, or other device that is programmable with user identification information. Information about the barrier opening event may be communicated to a home automation system for use in determining patterns of behavior, as well as predict activities associated with the building that may occur in the future. Further, information about the barrier opening may be used to control, for example, whether a handle of the barrier remains locked or is automatically unlocked. The automated control of the barrier may be overridden based on various factors such as, for example, the person operating the barrier, the time of day, or the type of barrier.

Figure 2:
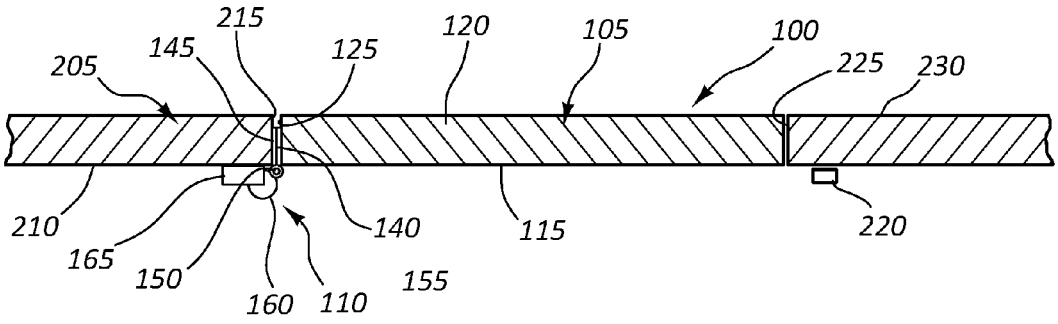
FIG. 2 is a top view of the door assembly shown in FIG. 1 with the door in a closed position.
Figure 3:
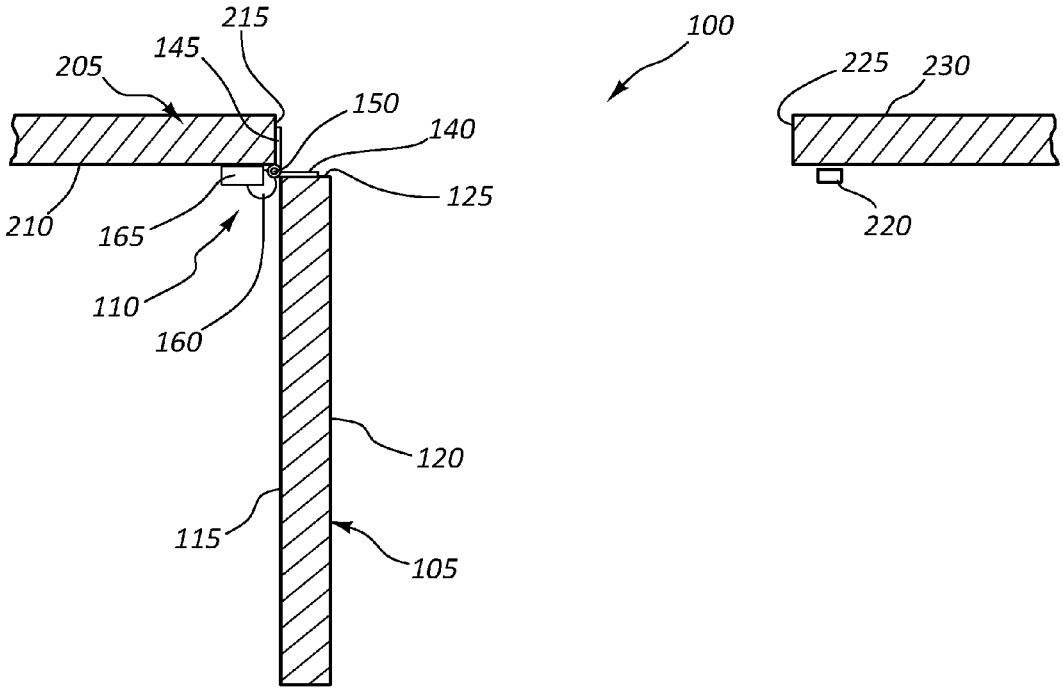
FIG. 3 is a top view of the door assembly shown in FIG. 1 with the door in an open position.

FIGS. 1-3 show a door assembly 100 having a door 105 and a hinge assembly 110. Referring first to FIG. 1, the door 105 includes inside and outside surfaces 115, 120, and an end surface 125. Hinge assembly 110 includes a hinge 130 and a hinge sensor 135. The hinge assembly 110 is mounted to the door 105 with the hinge 130 mounted directly to door 105 and hinge sensor 135 mounted to hinge 130 via a magnetic connection.

Hinge 130 includes first and second hinge plates 140, 145 that are connected to each other with a hinge pin 150. The first and second hinge plates 140, 145 pivot or rotate relative to each other about the hinge pin 150. The first hinge plate 140 is connected directly to door 105 (e.g., to end surface 125). The second hinge plate 145 is mounted to a support structure such as a door frame 205 (see FIGS. 2 and 3).

Hinge sensor 135 includes a housing 160 and a movable member 165. The housing 160 is configured to include a vertical concavity that is complementary to the vertical convexity of the hinge 130. Hinge sensor 135 therefore couples to hinge 130 by mating the complementary concave and convex portions of each, respectively, via a magnetic connection between the hinge sensor 135 and the hinge 130. By this configuration, hinge sensor 135 may be easily mounted to and removed from hinge 130, without the need to disassemble hinge 130 or make any holes or other modifications to door 105.

Housing 160 may include movable member 165. Housing 160 may include a hollow interior (not shown) configured to house at least one power supply such as a battery. Housing 160 may also be configured to house other components such as, for example, a sensor, a transceiver, a magnet, a processor, memory, or the like. Housing 160 may maintain a fixed position relative to hinge 130.

Housing 160 may have any desired shape and size. In one example, housing 160 has a generally cylindrical shape with a circular cross-section, and further having a vertical concavity along the surface of housing 160 configured to couple to hinge 130, as shown in FIGS. 1-3. Housing 160 may include a mounting structure such as a low friction surface, an axle, a recess, or other feature sized and arranged for interfacing with movable member 165.

Movable member 165 may extend from housing 160. Movable member 165 may be movable relative to housing 160. In at least one example, movable member 165 rotates about a longitudinal axis of hinge pin 150. Relative movement between movable member 165 and housing 160 may be detected and measured as part of determining an open state and/or an open position of door 105. Data from hinge sensor 135 may be translated wirelessly to a remotely located controller. The controller may be part of, for example, a home automation system.

Referring to FIG. 2, door assembly 100 is shown with door 105 in a closed position relative to door frame 205. Door frame 205 includes an outer surface 210 and an inside surface 215. First hinge plate 140 is mounted to end surface 125 of door 105. Second hinge plate 145 is mounted to inside surface 215 of door frame 205. Movable member 165 is arranged in contact with outer surface 210 of door frame 205. In other arrangements, movable member 165 may be arranged in contact with inside surface 115 of door 105 rather than a surface of door frame 205.

As door 105 is moved from a closed position shown in FIG. 2 to the open position shown in FIG. 3, the movable member 165 rotates relative to housing 160. The relative movement between movable member 165 and housing 160 and/or the absolute position of movable member 165 relative to another feature of hinge assembly 110 (e.g., first hinge plate 140, a magnet or other reference feature mounted to, for example, housing 160) may be measured by a sensor feature of hinge sensor 135. Hinge sensor 135 may determine an angular position of movable member 165 by a change in angular position, a distance of separation, or a change in separation distance between movable member 165 and other features of hinge assembly 110. The measured values corresponding to a position of movable member 165 may be converted into information related to a position of door 105 relative to door frame 205 (i.e., an open or closed position, or a rotated position of the door in any of an infinite number of open positions).

Figure 4:
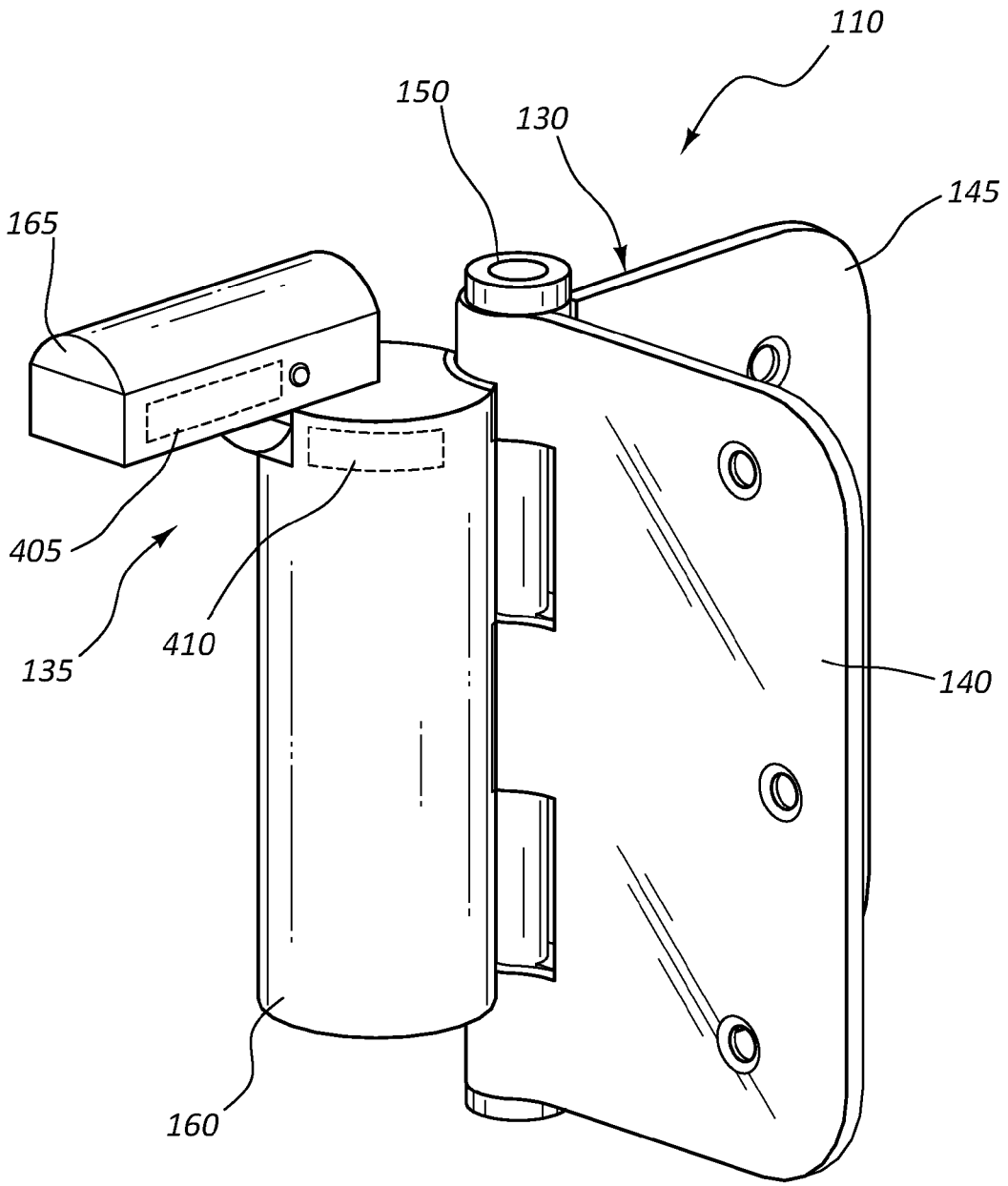
FIG. 4 is a perspective view of the magnetic hinge assembly shown in FIG. 1.
Figure 5:
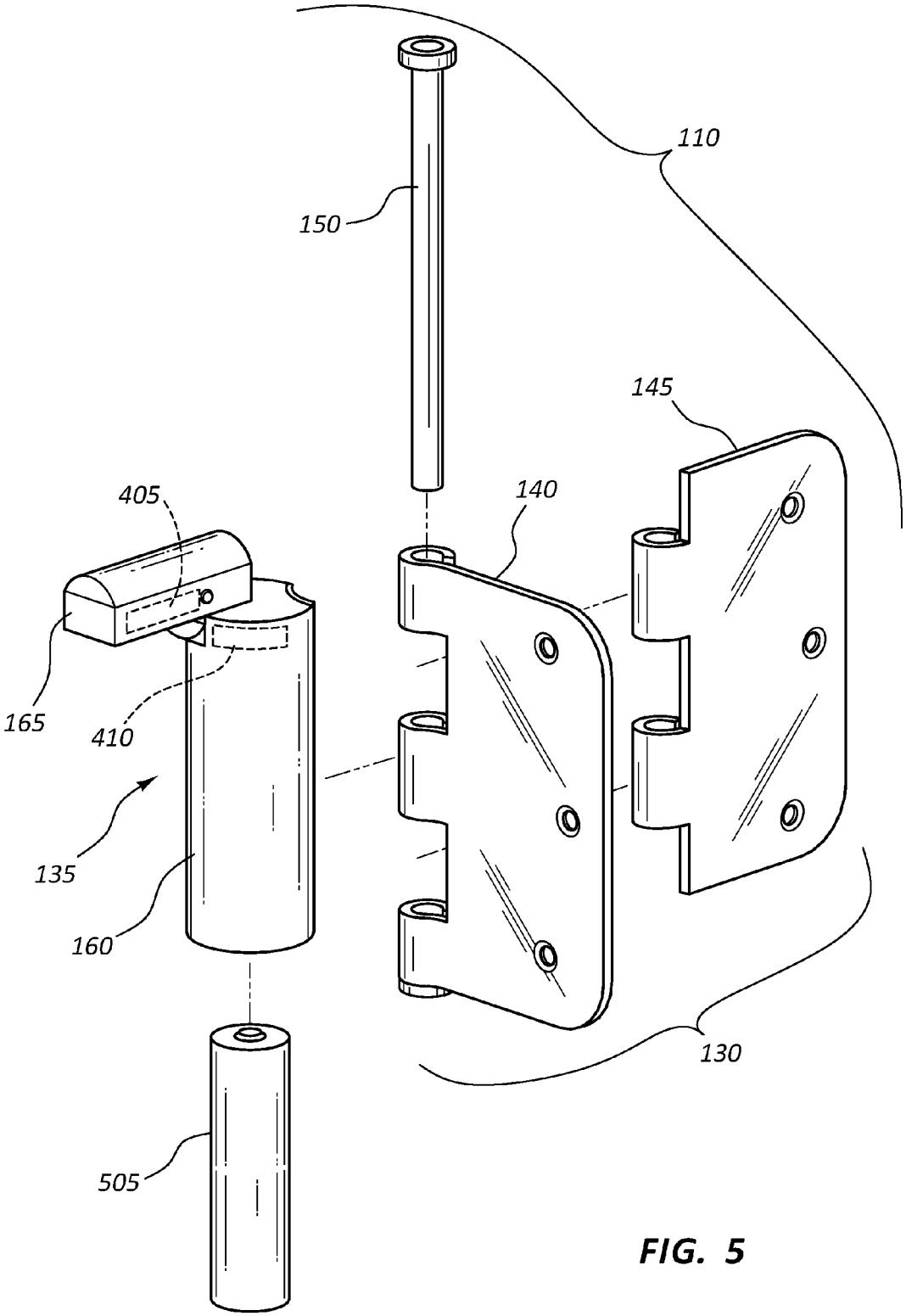
FIG. 5 is an exploded perspective view of the magnetic hinge assembly shown in FIG. 1.

FIGS. 4 and 5 illustrate the hinge assembly 110 in further detail. FIG. 4 shows a sensor 405 included with the movable member 165. Alternatively, sensor 405 may be mounted to housing 160. Sensor 405 may include any of a number of sensors including, for example, a passive or active infrared (IR) sensor, a potentiometer, or other type of positioning sensor. In one embodiment, sensor 405 may include a motion sensor. Sensor 405 may be configured to determine relative motion between any of door 105, hinge assembly 110, and door frame 205. Sensor 405 may be operable to detect motion in one or more living spaced associated with door assembly 100, such as motion in or around door 105. In some embodiments, multiple sensors 405 may be included with hinge assembly 110, wherein at least one of the sensors 405 is a motion sensor configured to detect motion in or close proximity to door 105 and/or a room or other living space for which door 105 control access.

FIG. 4 also shows a transceiver 410 associated with housing 160. Alternatively, transceiver 410 may be mounted to movable member 165. Transceiver 410 may provide wireless communication with a remote source such as, for example, a controller of a home automation system. In some arrangements, transceiver 410 may be configured as a transmitter only, while in other arrangements transceiver 410 may be capable of both transmitting and receiving data wirelessly. Two-way communications with hinge assembly 110 may have advantages in some scenarios such as, for example, providing software updates, confirming functionality, or running maintenance testing from a remote location.

FIG. 5 shows a battery 505 that is received in housing 160. Battery 505 may provide power for operation of sensor 405, transceiver 410, and other electronic components of hinge sensor 135.

Referring again to FIGS. 2 and 3, door assembly 100 may further include one or more motion sensors 220. Motion sensor 220 may provide an independent determination of movement separately from operation of hinge sensor 135. For example, motion sensor 220 may be positioned on door frame 205 such as along outer surface 210 opposite a location where door 105 is mounted to inside surface 215 of door frame 205. Motion sensor 220 may operate to identify motion that occurs in or around a doorway 225 defined by door frame 205, or motion in close proximity to door 105. In some arrangements, motion sensor 220 may be positioned on an opposite side of door frame 205 (e.g., along an inner surface 230 as shown in FIGS. 2 and 3). In other arrangements, motion sensor 220 may be mounted to hinge assembly 110, or be part of sensor assembly 135 (e.g., be arranged at the location of sensor 405 or transceiver 410 shown in FIGS. 4 and 5). Motion sensor 220 and sensor assembly 135 may be integrated or combined as a single assembly that is mounted to door 105 and/or hinge 130. In one embodiment, multiple motions sensors 20 are used, wherein one or more motion sensors may be positioned at various locations in a living space such as mounted to door frame 205, mounted to hinge sensor 110, or positioned at another location spaced away from door assembly 100.

The data collected by motion sensor 220 may be used in combination with data from hinge sensor 135 related to an open state and/or open position of door 105. In one example, hinge sensor 135 may provide data that indicates the door 105 has moved from the closed position shown in FIG. 2 to an open position sufficient to permit a person to pass through the doorway 225. The motion sensor 220 may identify motion occurring on the outer surface 210 side of door frame 205 before or after hinge sensor 135. The detected motion may confirm opening or closing of the door 105. The motion detected by motion sensor 220 may confirm that a person or other object has passed through the doorway. This additional data point of detected motion may be advantageous as compared to other scenarios in which only the open or closed state of the door is detected. In at least some situations, a door may open inadvertently (e.g., if not properly latched) and the motion sensor 220 may confirm that no object moved through the doorway, which confirms that the movement of the door may have been inadvertent.

Motion sensor 220 may be positioned at any location relative to door 105 and/or hinge assembly 110. FIGS. 2 and 3 show motion sensor 220 mounted to door frame 205. In other examples, motion sensor 220 may be positioned on a ceiling, on an opposite wall, along an overhead portion of a door frame or on the floor. Motion sensor 220 may be integrated into an appliance such as, for example, a light fixture, light switch, speaker or microphone, or control panel.

Figure 6:
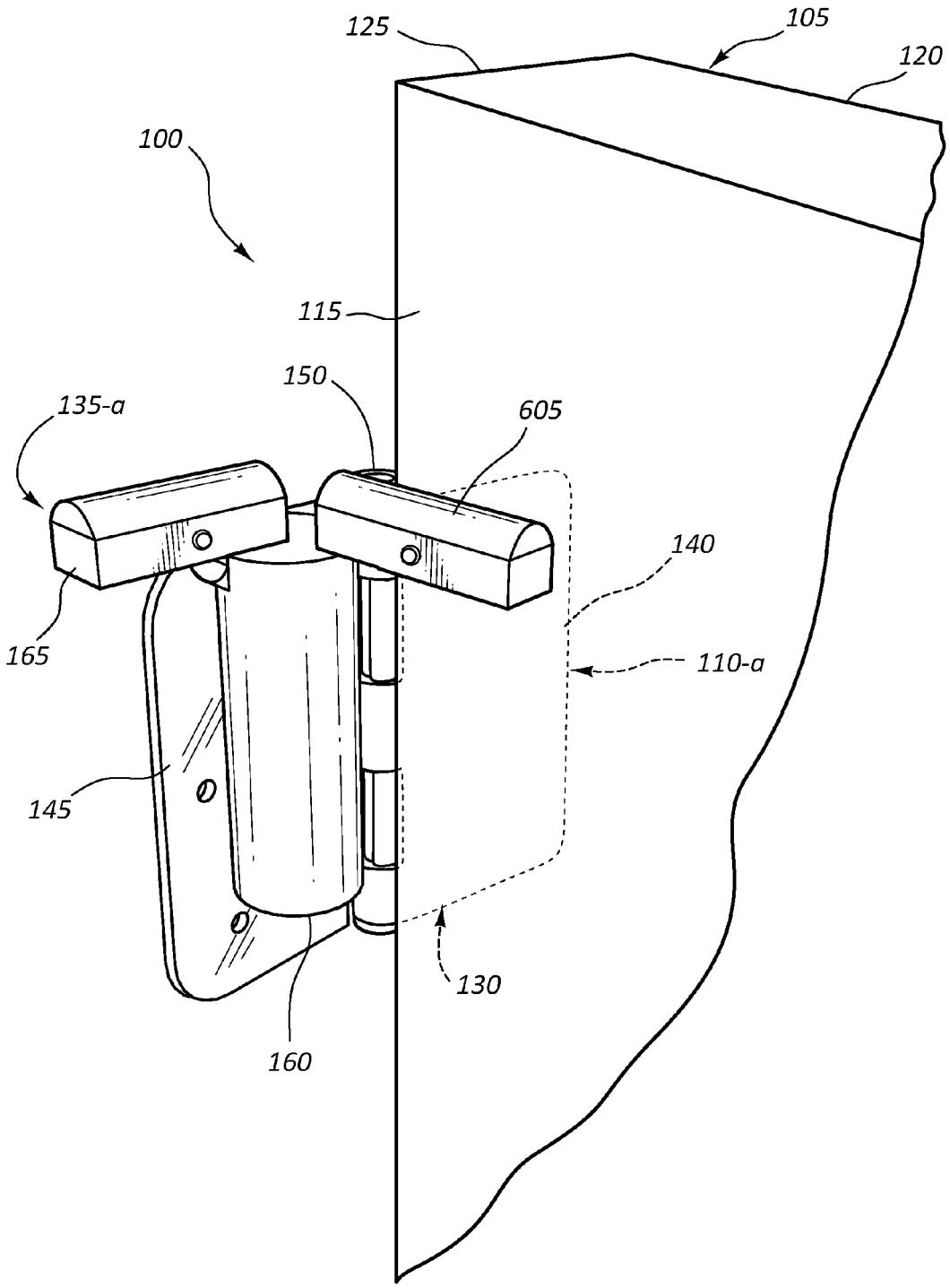
FIG. 6 is a perspective view of a door assembly having a door and a magnetic hinge assembly in which the systems and methods disclosed herein may be implemented.
Figure 7:
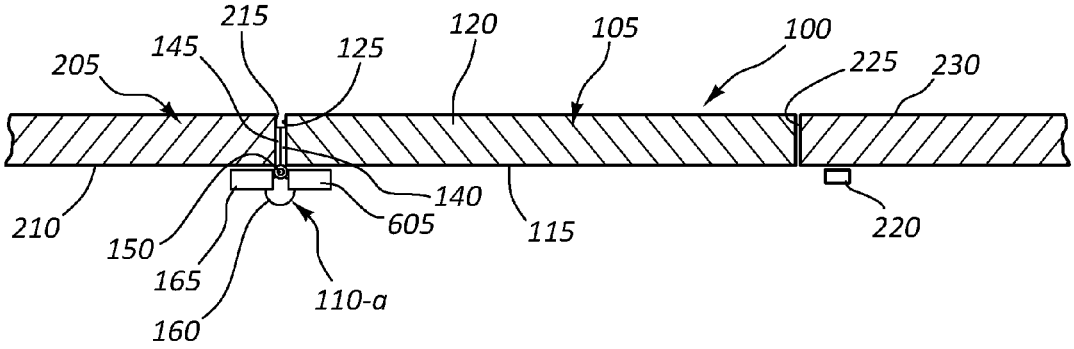
FIG. 7 is a top view of the door assembly shown in FIG. 6 with the door in a closed position.
Figure 8:
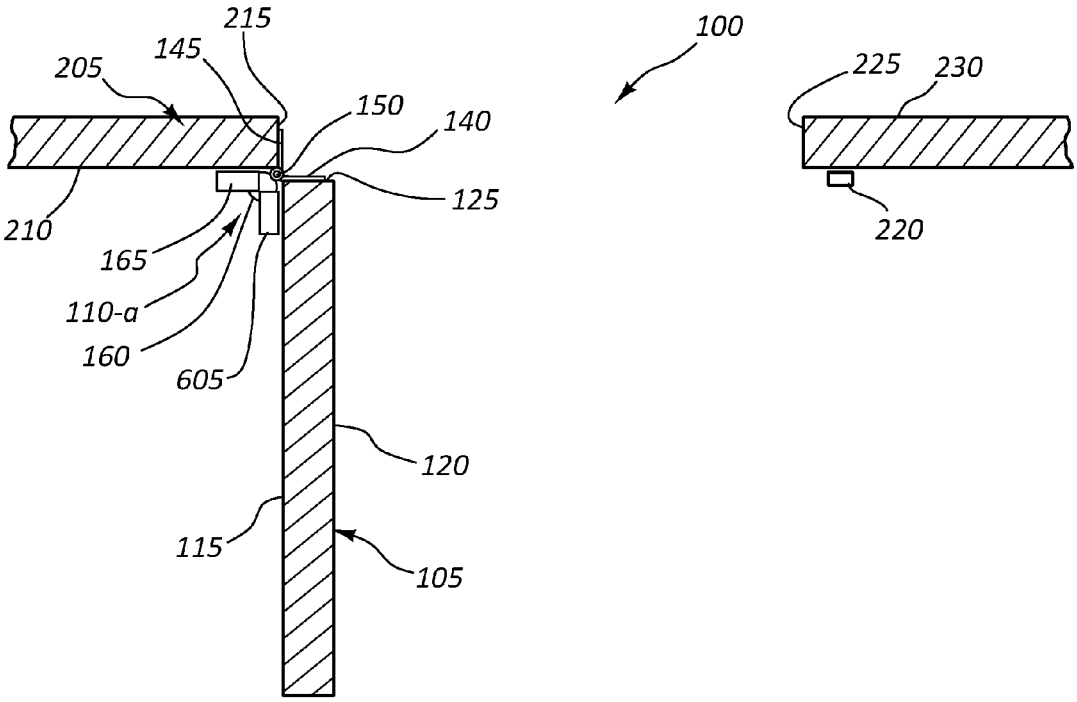
FIG. 8 is a top view of the door assembly shown in FIG. 6 with the door in an open position.

FIGS. 6-8 illustrate another example door assembly 600. FIG. 6 shows door assembly 600 including door 105 and hinge assembly 110-*a*. Hinge assembly 110-*a* includes hinge 130 and a hinge sensor 135-*a*. Hinge sensor 135-*a* includes housing 160, movable member 165, and fixed arm 605. Movable member 165 and fixed arm 605 may both be mounted to housing 160. Movable member 165 may be movable relative to housing 160 and/or fixed arm 605. Fixed arm 605 may be fixed relative to housing 160. In some embodiments, movable member 165 and fixed arm 605 may be switched in position on housing 160. In other embodiments, movable member 165 and fixed arm 605 may be positioned at other locations on housing 160, such as at opposite ends of housing 160. Relative movement between movable member 165 and fixed arm 605 may be detected and/or measured as part of determining an open state and/or open position of door 105.

FIGS. 7 and 8 show hinge assembly 110-*a* mounted to door 105 and door frame 205. Movable member 165 is arranged in contact with outer surface 210 of door frame 205. Fixed arm 605 is arranged in contact with inside surface 115 of door 105. As the door 105 is moved from a closed position shown in FIG. 7 to an open position shown in FIG. 8, the movable member 165 is rotated relative to fixed arm 605. Movement of movable member 165 relative to fixed arm 605 may be measured as, for example, a change in angle, an absolute angle, a change in distance, or an absolute distance.

The movable member 165 of door assemblies 100, 600 may be biased into contact with door frame 205 and/or door 105. The biasing force may be applied by one or more springs that apply a torque force that maintains contact between movable member 165 and the door frame 205 and/or door 105 depending on the arrangement of the hinge sensor 135.

Figure 9:
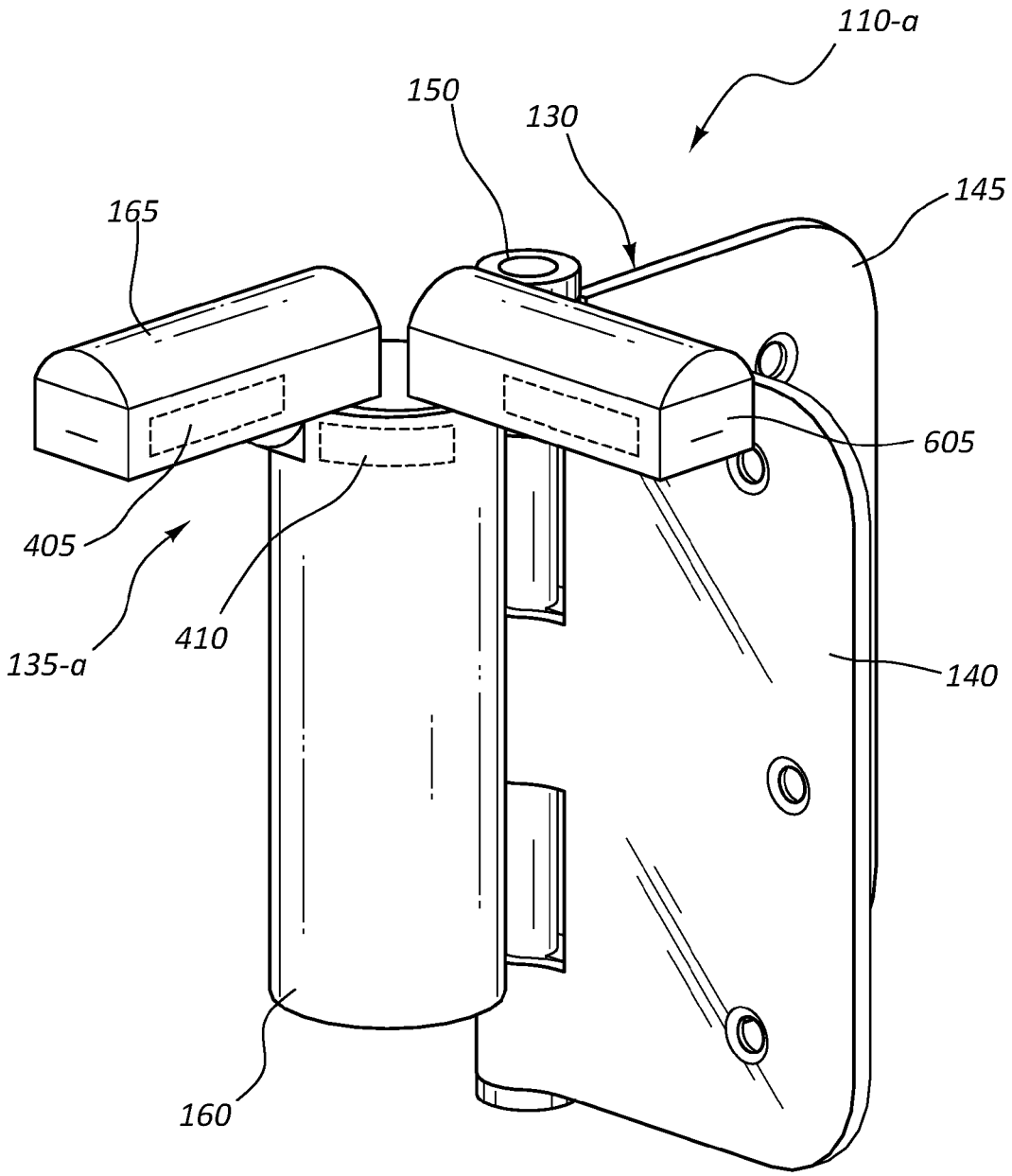
FIG. 9 is a perspective view of the magnetic hinge assembly shown in FIG. 6.
Figure 10:
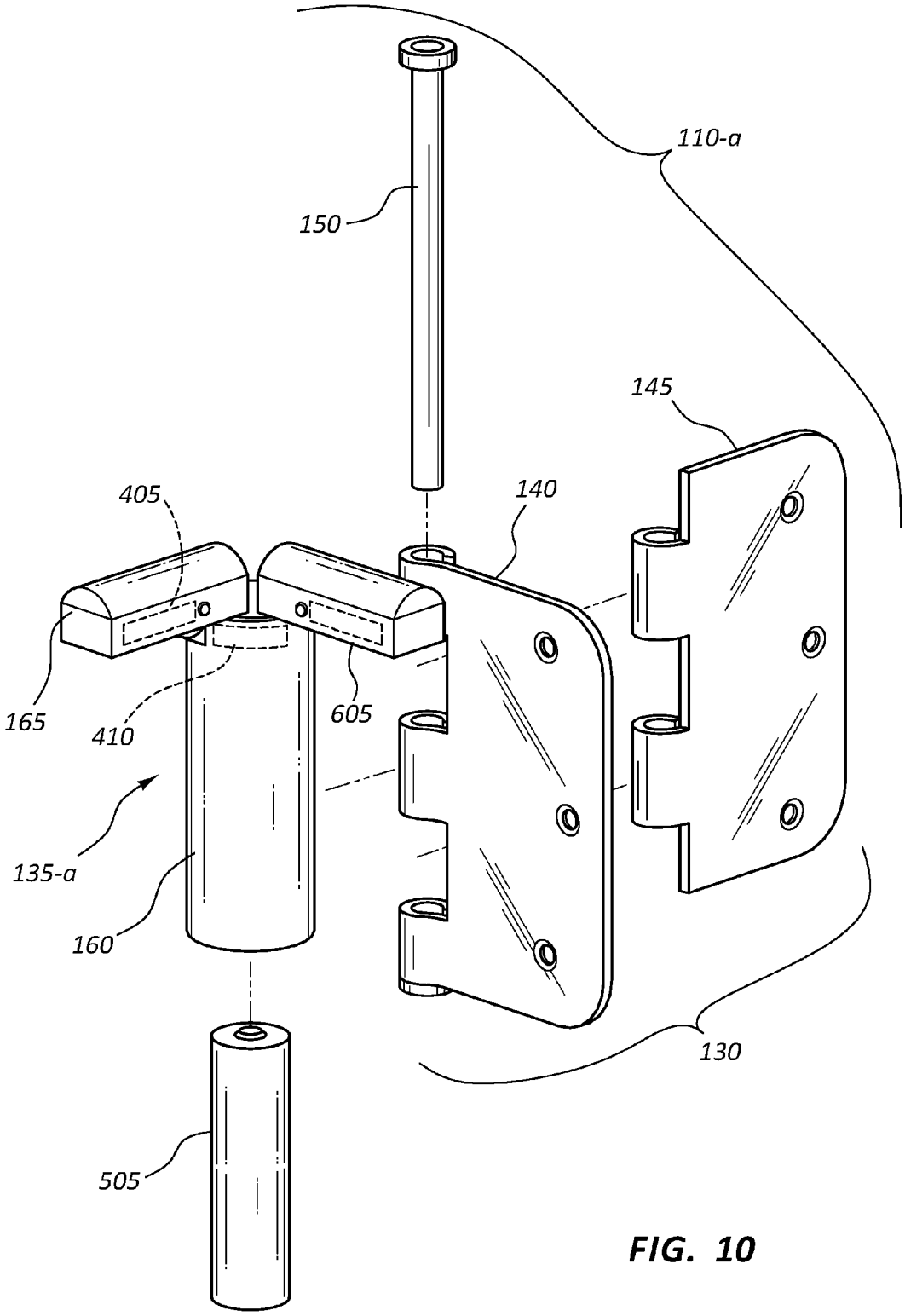
FIG. 10 is an exploded perspective view of the magnetic hinge assembly shown in FIG. 6.

FIGS. 9 and 10 show the hinge assembly 110-*a* in further detail. Hinge assembly 110-*a* includes sensor 405, transceiver 410, and battery 505, which may be carried by any one of the housing 160, movable member 165, and fixed arm 605. In some arrangements, sensor 405, transceiver 410, and battery 505 may each be carried by a separate component of hinge assembly 110-*a*. Hinge assembly 110-*a* may also include a reference member 905 carried by, for example, fixed arm 605 or some other component of hinge assembly 110-*a* for use as a reference for sensor 405. Hinge assembly 110-*a* may include additional or fewer components as compared to those shown in FIGS. 9 and 10. For example, hinge assembly 110-*a* may include a plurality of sensors, a processor, memory, and other electronic and/or mechanical components.

The embodiments shown in FIGS. 1-10 are directed to hinge assemblies that are used with doors. Doors are just one type of barrier used to control access to an opening of a building or other structure. The hinge assemblies disclosed herein may be used with other types of barriers such as windows.

The hinge sensors shown with reference to FIGS. 1-3 are mounted to a hinge using a magnetic interface between the hinge sensor and the hinge. In particular, the hinge sensor may be configured to have a vertically concave portion that is complementary to the vertically convex configuration of the hinge surface. The hinge sensor may therefore be coupled to the hinge via this complementary shaping and a magnetic force.

The hinge sensors and hinge assemblies disclosed herein may be used in combination with other features of a barrier. For example, a drive mechanism may be mounted to a barrier to apply a force that opens or closes the barrier. The operation of the drive may be controlled at least in part based on feedback from the hinge sensor. For example, the hinge sensor may indicate that the barrier is arranged at a 45° open position relative to a closed position. Alternatively, the open position of the door may be defined as a percentage (e.g., 25% open) or a distance (e.g., 18 inches open). A user may provide input for opening the door to a position of 90°, which may be carried out by operating the drive to further open the door. In another example, the hinge sensor may indicate that the barrier is in any open position. The drive may be operated to close the barrier based on, for example, a time of day, a weather condition, or some other parameter measured automatically by a home automation system or controlled manually by a user. The barrier may be confirmed closed by further feedback from the hinge sensor, a motion sensor, or other feature of the home automation system.

Figure 11:
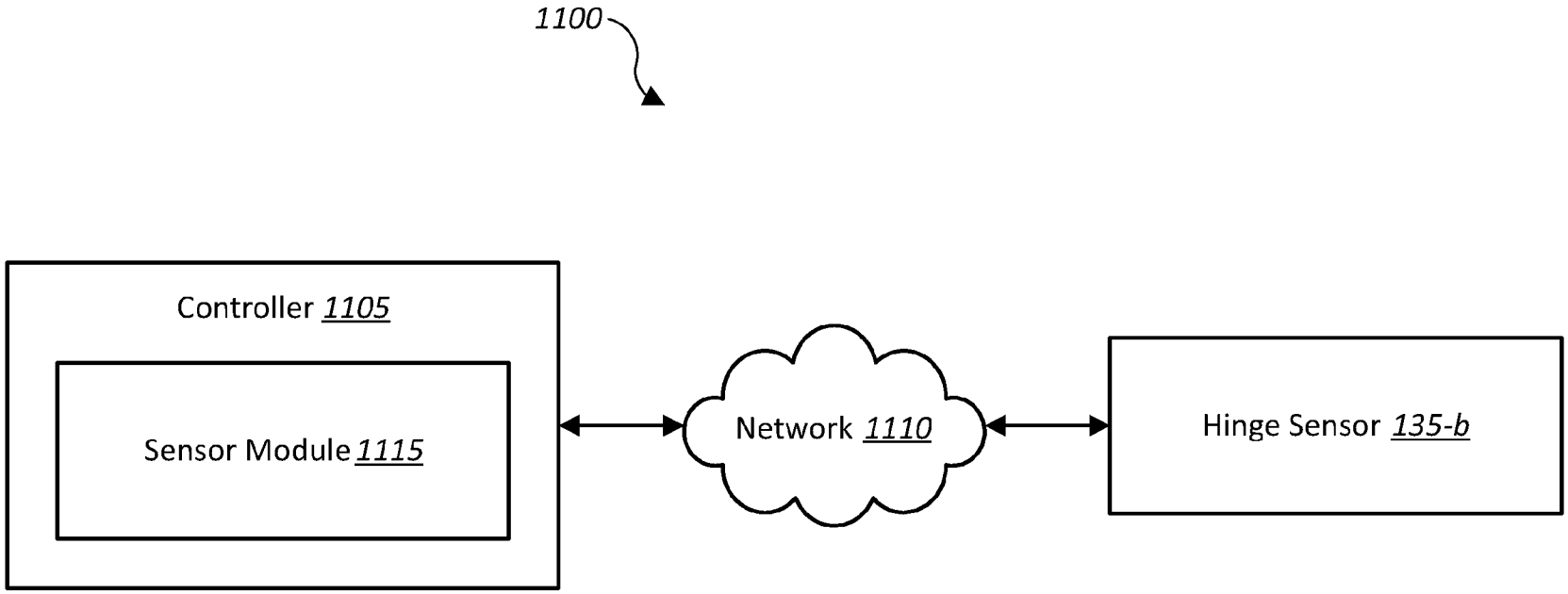
FIG. 11 is a block diagram of an environment in which the present systems and methods may be implemented.

FIG. 11 is a block diagram illustrating one embodiment of an environment 1100 in which the present systems and methods may be implemented. In some embodiments, the systems and methods described herein may be performed on or using a hinge sensor 135-*b* that communicates with a controller 1105 via a network 1110. Controller 1105 includes a sensor module 1115. Hinge sensor 135-*b* may generate and transmit information concerning an open state and/or position of a barrier such as a door or window with which the hinge sensor 135-*b* is operated. The sensor signals and/or other information generated by hinge sensor 135-*b* may be transmitted over network 1110 to controller 1105. Sensor module 1115 may determine, at least in part using the information received from hinge sensor 135-*b*, an operation state and/or position of the barrier. The network 1110 provides communication via, for example, a wired or wireless connection.

Hinge sensor 135-*b* may include one or more sensors and operate to determine at least one operational parameter or characteristic of a barrier (e.g., as described above with reference to FIGS. 1-10). For example, hinge sensor 135-*b* may determine whether a barrier (e.g., a door or window of a building) is in a closed state or in an open state. In another example, hinge sensor 135-*b* may indicate an open position of a barrier or a change in position of an open barrier (e.g., a change between a 30° rotated position and a 90° rotated position when a closed position is at 0°).

In examples where hinge sensor 135-*b* includes a plurality of different sensors, one sensor may provide one set of information related to the barrier (e.g., an open or closed state of the barrier) and another sensor may indicate a rotated or other open position of the barrier relative to the closed position. The combination of information provided by the various sensors may be utilized by the sensor module 1115 to determine an operation state or position of the barrier. In another example, an additional sensor may determine motion of the barrier itself or other objects that pass through or are in close proximity to the opening controlled by the barrier. For example, a motion sensor (e.g., motion sensor 220 described with reference to FIGS. 2 and 3) may be part of or associated with hinge sensor 135-*b*. The various sensors and functionality of hinge sensor 135-*b* may help determine from which side a barrier is opened (e.g., on an interior side or an exterior side of the barrier), or whether an object has passed through the opening whose access is controlled by the barrier. Information related to which side of a barrier the barrier is being operated and/or whether an object passes through the opening controlled by the barrier may be helpful in deducing other types of information, patterns, occupant locations, etc., that may be used to provide other features and functionality related to, for example, the barrier itself and/or a home automation system within which the controller 1105, network 1110, and hinge sensor 135-*b* operate.

In some examples, environment 1100 represents at least a portion of a home automation system. The controller 1105 may be part of, for example, a control panel of the home automation system. The hinge sensor 135-*b* may be associated with a barrier that provides an access point into a home (e.g., a door or window). Network 1110 may include or be part of a wireless network, a wired network, or some combination thereof.

Figure 12:
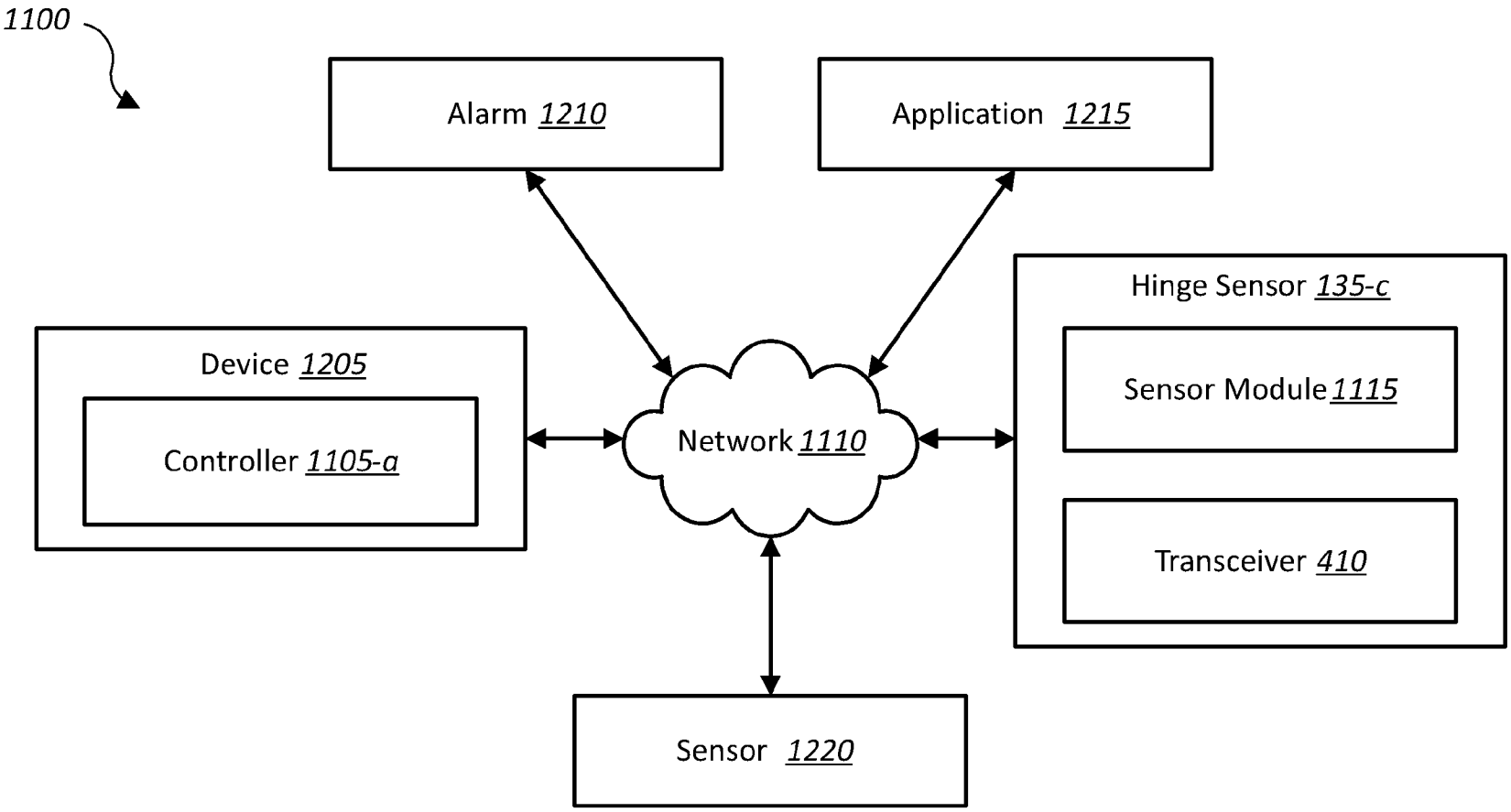
FIG. 12 is a block diagram of an environment in which the present systems and methods may be implemented.

Referring now to FIG. 12, in some embodiments, an environment 1200 may include the components of environment 1100 described above, and may further include the sensor module 1115 as part of a hinge sensor 135-*c*. Environment 1200 may also include a device 1205 to which the controller 1105-*a* belongs. In some examples, device 1205 includes, for example, a control panel of a home automation system, a back end server or a central station of the home automation system. Environment 1200 may also include an alarm 1210, an application 1215, and a sensor 1220. Hinge sensor 135-*c* may additionally include transceiver 410.

Device 1205 may include, for example, a control panel of the home automation system. Alternatively, device 1205 may be a portable electronic device including, for example, a touch screen display. Device 1205 may be in communication with one or more sensors such as hinge sensor 135-*c* via network 1110. Additionally, or alternatively, device 1205 may be in communication with other types of sensors such as, for example, sensor 1220. Device 1205 may also be in communication with alarm 1210 and application 1215.

Controller 1105-*a* may include at least some processing or logic capability and provide communication with at least some of the sensors with which device 1205 communicates (e.g., hinge sensor 135-*c*).

Alarm 1210 may provide a text message, an audible sound, lights, or the like that provide communication with one or more users on the property being monitored by a home automation system. Alarm 1210 may provide communications with a remote device or system related to a condition of the property being monitored. Alarm 1210 may be integrated into device 1205. Alarm 1210 may operate in response to data received from hinge sensor 135-*c* such as, for example, an unauthorized opening or closing of a barrier.

Application 1215 may allow a user to control (either directly or via, for example, controller 1105-*a*) an aspect of the monitored property, including a security, energy management, locking or unlocking of a barrier, checking the status of a barrier, locating a user or item, controlling lighting, thermostats, or cameras, receiving notifications regarding a current status or anomaly associated with a home, office, place of business, and the like. In some configurations, application 1215 may enable hinge sensor 135-*c* to interface with device 1205 and utilize a user interface to display automation, security, and/or energy management content on a display, user interface, mobile computing device, or other feature of environment 1200 and/or device 1205. Application 1215, via a user interface, may allow users to control aspects of their home, office, and/or other type of property. Further, application 1215 may be installed on a mobile computing device in order to allow a user to interface with functions of the components shown in environment 1200 (e.g., hinge sensor 135-*c*), such as components of a home automation and/or home security system.

Sensor 1220 may represent one or more separate sensors or a combination of two or more sensors in a single sensor device. For example, sensor 1220 may represent one or more camera sensors and one or more motion sensors connected to environment 1200. Additionally, or alternatively, sensor 1220 may represent a combination sensor such as both a camera sensor and a motion sensor integrated into the same sensor device. Additionally, or alternatively, sensor 1220 may be integrated into a home appliance or a fixture such as a light bulb fixture and/or the hinge sensor 135-*c*. Sensor 1220 may include an accelerometer to enable sensor 1220 to detect a movement. Sensor 1220 may include a wireless communication device that enables sensor 1220 to send and receive data and/or information to and from one or more devices in environment 1200 (e.g., such as a controller 1105-*a*). Additionally, or alternatively, sensor 1220 may include a GPS sensor to enable sensor 1220 to track a location of sensor 1220. Sensor 1220 may include a proximity sensor to enable sensor 1220 to detect proximity of a user relative to a predetermined distance from a dwelling (e.g., a geo fence or barrier). Sensor 1220 may include one or more security detection sensors such as, for example, a glass break sensor, a motion detection sensor, or both. Additionally, or alternatively, sensor 1220 may include a smoke detection sensor, a carbon monoxide sensor, or both. In at least some examples, sensor 1220 may detect the presence of a user within a dwelling or entryway into a home monitored by components of environment 1200, performing certain functions (e.g., opening a door or window), or speaking a voice command. Sensor 1220 may be integrated into or used in place of either one of hinge sensor 135-*c* and other sensors associated with the property being monitored by a home automation system of environment 1200. Sensor 1220 may include motion sensor 220 described above with reference to FIGS. 2-3 and 7-8.

Network 1110 may include cloud networks, local area networks (LAN), wide area networks (WAN), virtual private networks (VPN), wireless networks (using 802.11, for example), and/or cellular networks (using 3G or LTE, for example), etc. In some embodiments, the network 1110 may include the internet.

Figure 13:
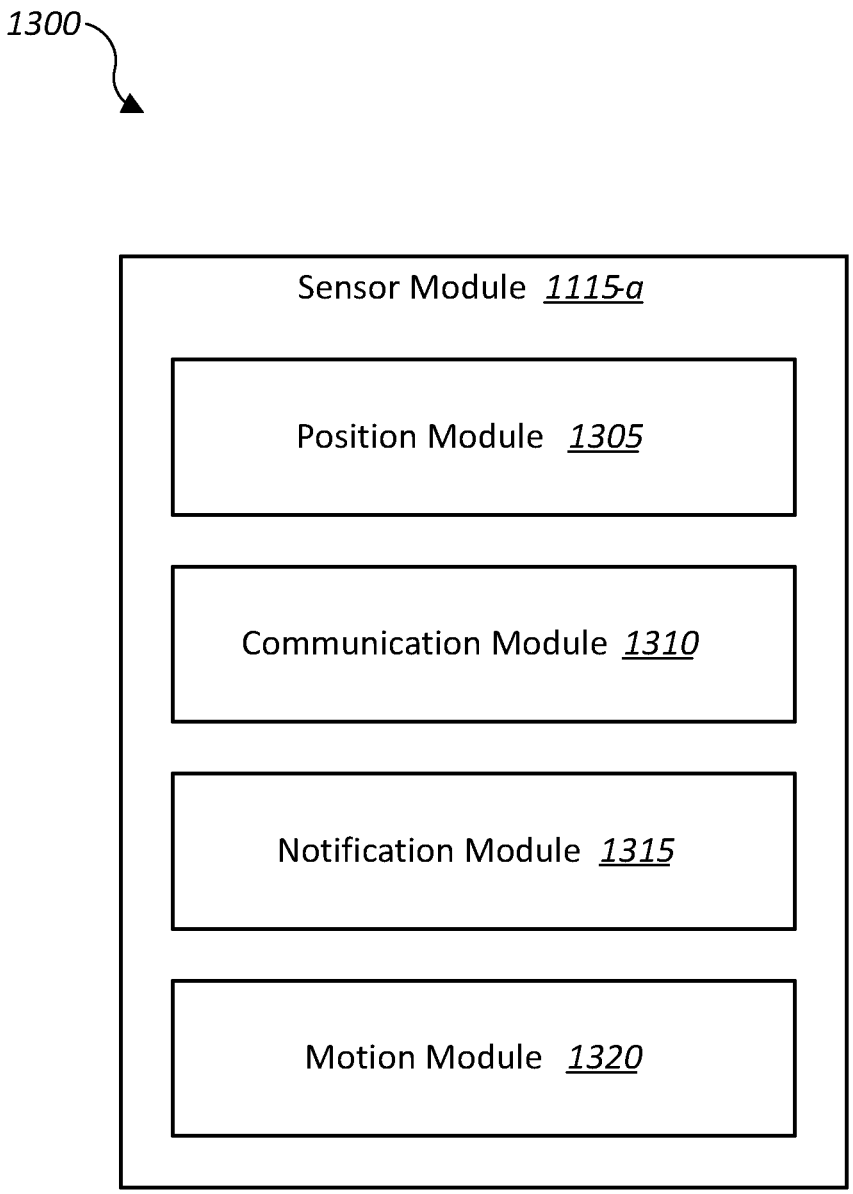
FIG. 13 is a block diagram of a sensor module.

FIG. 13 is a block diagram showing a sensor module 1115-*a*. Sensor module 1115-*a* may be one example of the sensor module 1115 shown in FIGS. 11 and 12. Sensor module 1115-*a* may include a position module 1305, a communication module 1310, a notification module 1315, and a motion module 1320. Position module 1305 may operate to receive information about a position of a barrier as received from, for example, a hinge sensor 135 of FIGS. 1-12. Position module 1305 may determine from data received from the hinge sensor an open or closed state of the barrier, a relative position of the barrier to a reference point (e.g., a closed state of the barrier), or a direction of change in position of the barrier, or an absolute amount of change in position of the barrier.

Communication module 1310 may provide communication to and from hinge sensor 135. In at least some examples, communication module 1310 may receive communications via, for example, transceiver 410 of hinge sensor 135 (e.g., see description of FIGS. 5 and 10). Communication module 1310 may deliver data to hinge sensor 135 such as, for example, instructions, software patches, and maintenance data. The information received from hinge sensor 135 via communication module 1310 may be provided to position module 1305.

Notification module 1315 may use position information provided by position module 1305 and determine whether the state of the barrier or other information provided by hinge sensor 135 should be communicated to another device or a user. For example, notification module 1315 may send notice to alarm 1210 to generate an audible, visual or other type of alarm based on an open or closed state or open position of the barrier as determined using hinge sensor 135. Notification module 1315 may push notifications to a user via, for example, text messages, emails, or the like via, for example, a control panel of the home automation system, a computing device such as a desktop, laptop, notebook, or handheld computing device, or the like.

Motion module 1320 may receive data from other sensors such as, for example, motion sensor 220 shown in FIGS. 2-3 and 7-8. Motion module 1220 may correlate the position information provided by hinge sensor 135 with motion information from motion sensor 220. The notification module 1315 may receive both position and motion data from position module 1305 and motion module 1320, respectively, as part of determining whether a notification should be generated and transmitted.

Figure 14:
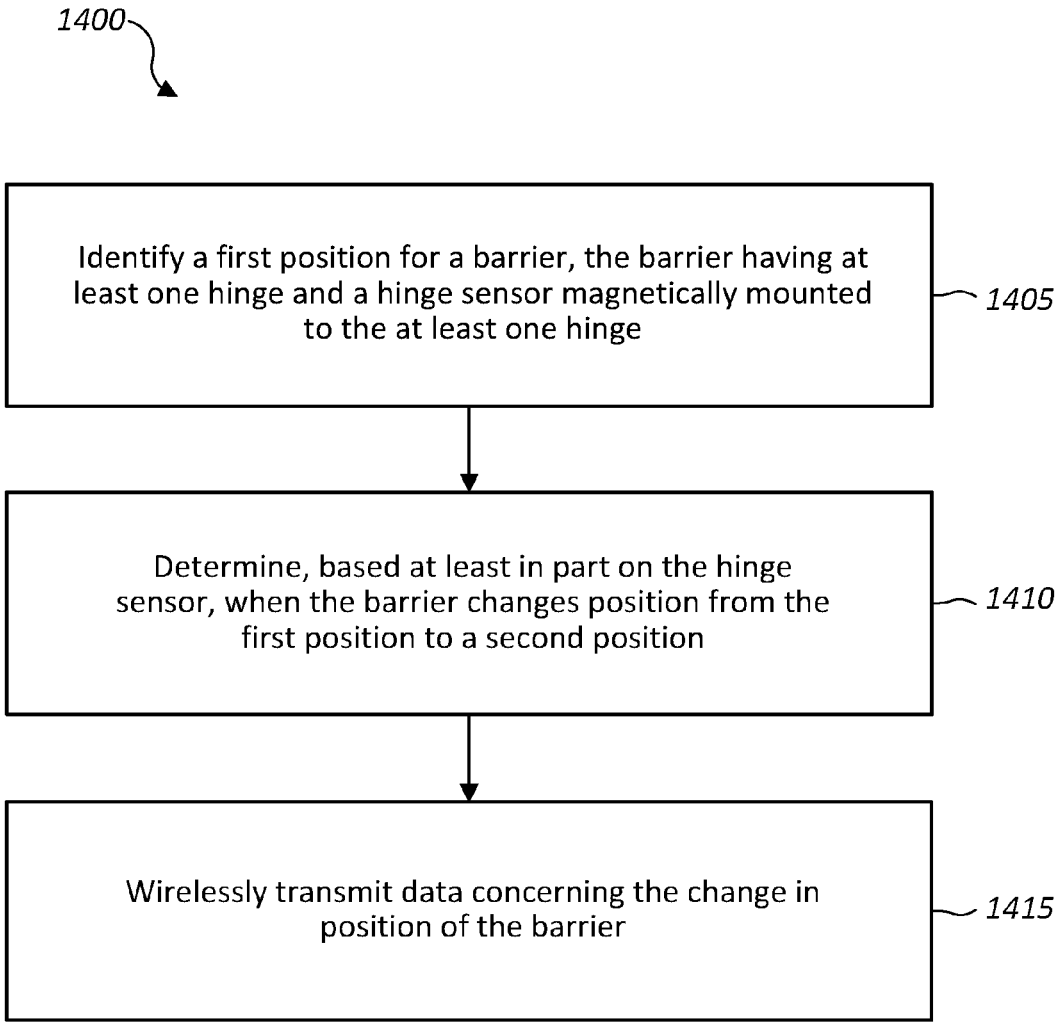
FIG. 14 is a flow diagram showing steps of an example method in accordance with the present disclosure.

FIG. 14 is a flow diagram illustrating one embodiment of a method 1400 for determining an open state of a barrier. In some configurations, the method 1400 may be implemented by the sensor module 1115-*a* shown in FIGS. 11-13. In other examples, method 1400 may be formed generally by controller 1105 shown in FIG. 11, hinge sensor 135-*c* shown in FIG. 12, or even more generally by the environments 1100, 1200 shown in FIGS. 1-5, respectively, or other components described with reference to FIGS. 1-10.

At block 1405, the method 1400 includes identifying a first position for a barrier, the barrier having at least one hinge and a hinge sensor magnetically mounted to the at least one hinge. Block 1410 includes determining, based at least in part on the hinge sensor, when the barrier changes position from the first position to a second position. At block 1415 of method 1400, the method includes wirelessly transmitting data concerning the change in position of the barrier.

Method 1400 may also include determining movement of the barrier with a motion sensor. The motion sensor may be part of the hinge sensor. The motion sensor may determine movement of an object passing through an opening that is controlled by the barrier. The hinge sensor may include a rotatable portion and a fixed portion, and the method may include fixing a position of the fixed portion relative to the hinge, and rotatably mounting the rotatable portion to the fixed portion such that the rotatable portion is arranged in contact with and movable by the barrier. The hinge sensor may include a motion sensor mounted to the fixed portion of the hinge sensor. The method 1400 may include determining with the motion sensor when an object moves through an opening that is controlled by the barrier. The first position may be a closed position and the second position may be an open position. The first position may be a first open position and the second position may be a second open position. The method 1400 may include determining at least one of the first and second positions.

Figure 15:
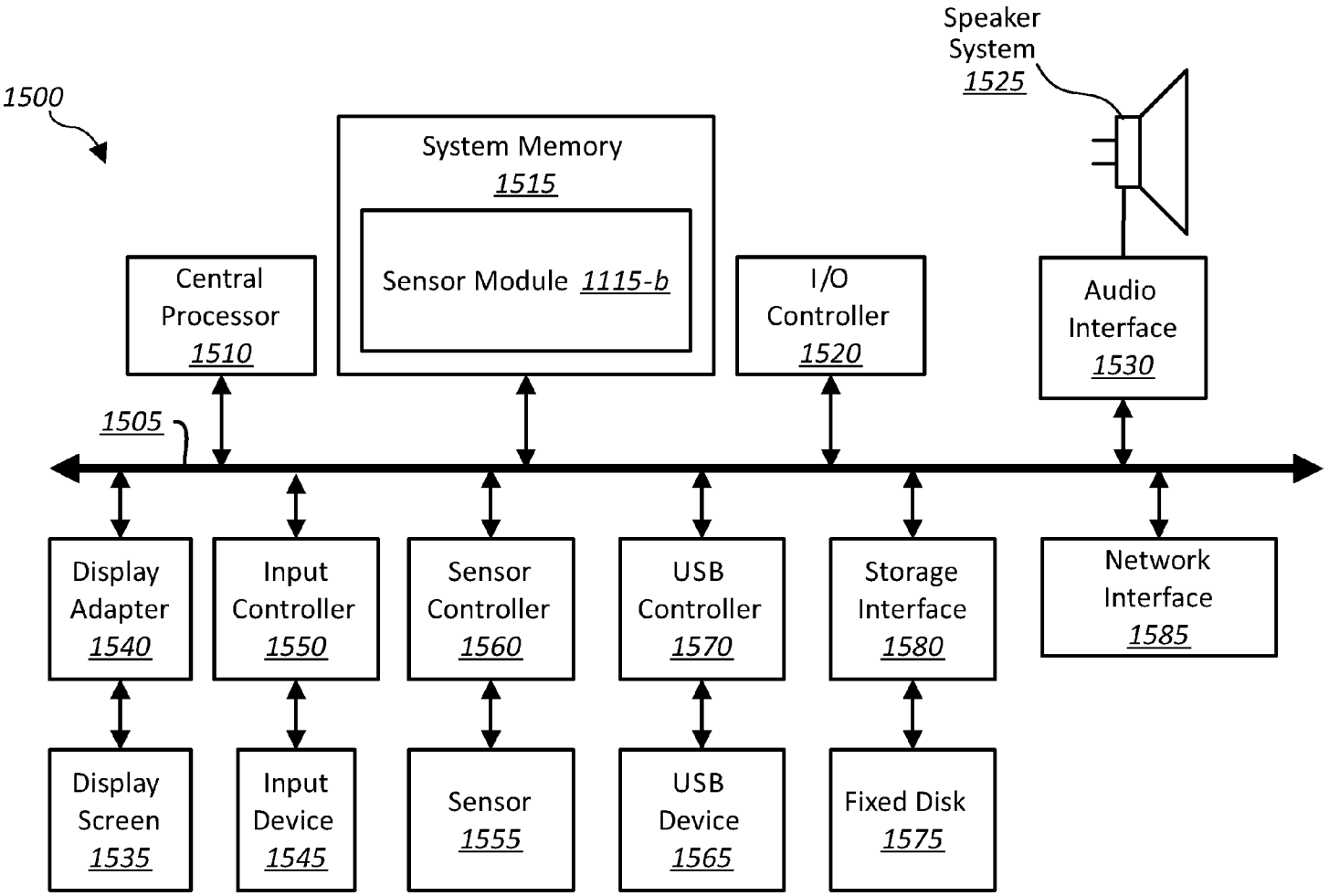
FIG. 15 is a block diagram of a computer system suitable for implementing the systems and methods of FIGS. 1-14.

FIG. 15 depicts a block diagram of a controller 1500 suitable for implementing the present systems and methods. The controller 1500 may be an example of the controller 1105 illustrated in FIGS. 11-12. In one configuration, controller 1500 includes a bus 1505 which interconnects major subsystems of controller 1500, such as a central processor 1510, a system memory 1515 (typically RAM, but which may also include ROM, flash RAM, or the like), an input/output controller 1520, an external audio device, such as a speaker system 1525 via an audio output interface 1530, an external device, such as a display screen 1535 via display adapter 1540, an input device 1545 (e.g., remote control device interfaced with an input controller 1550), multiple USB devices 1565 (interfaced with a USB controller 1570), and a storage interface 1580. Also included are at least one sensor 1555 connected to bus 1505 through a sensor controller 1560 and a network interface 1585 (coupled directly to bus 1505).

Bus 1505 allows data communication between central processor 1510 and system memory 1515, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, a sensor module 1115-*b* to implement the present systems and methods may be stored within the system memory 1515. The sensor module 1115-*b* may be an example of the sensor module 1115 illustrated in FIGS. 11-13. Applications (e.g., application 1215) resident with controller 1500 are generally stored on and accessed via a non-transitory computer readable medium, such as a hard disk drive (e.g., fixed disk 1575) or other storage medium. Additionally, applications can be in the form of electronic signals modulated in accordance with the application and data communication technology when accessed via interface 1585.

Storage interface 1580, as with the other storage interfaces of controller 1500, can connect to a standard computer readable medium for storage and/or retrieval of information, such as a fixed disk drive 1575. Fixed disk drive 1575 may be a part of controller 1500 or may be separate and accessed through other interface systems. Network interface 1585 may provide a direct connection to a remote server via a direct network link to the Internet via a POP (point of presence). Network interface 1585 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 1500 wirelessly via network interface 1585.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 15 need not be present to practice the present systems and methods. The devices and subsystems can be interconnected in different ways from that shown in FIG. 15. The aspect of some operations of a system such as that shown in FIG. 15 are readily known in the art and are not discussed in detail in this application. Code to implement the present disclosure can be stored in a non-transitory computer-readable medium such as one or more of system memory 1515 or fixed disk 1575. The operating system provided on controller 1500 may be iOS®, ANDROID®, MS-dOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A method for determining an open state of a barrier, comprising:

identifying a first position for the barrier, the barrier having at least one hinge and a hinge sensor magnetically mounted to the at least one hinge, wherein the hinge sensor comprises at least a fixed portion and a rotatable portion;

determining, based at least in part on a change in relative displacement of the rotatable portion in reference to the fixed portion, when the barrier changes position from the first position to a second position; and wirelessly transmitting data concerning the change in position of the barrier.

2. The method of claim 1, further comprising:

determining, via a motion sensor, the change in position of the barrier from the first position to the second position.

3. The method of claim 1, wherein the hinge sensor comprises a fixed portion, the method further comprising:

fixing a position of the fixed portion relative to the at least one hinge;

determining with the hinge sensor when the barrier is in a closed position; and detecting with the hinge sensor when the barrier changes position from the closed position.

4. The method of claim 3, wherein the fixed portion of the hinge sensor comprises a spring-loaded sensor.

5. The method of claim 1, further comprising:

fixing a position of the fixed portion relative to the at least one hinge; and rotatably mounting the rotatable portion to the fixed portion, the rotatable portion being arranged in contact with and movable by the barrier.

6. The method of claim 5, wherein the hinge sensor comprises a motion sensor, the motion sensor being mounted to the fixed portion.

7. The method of claim 6, further comprising:

determining, based at least in part on the motion sensor, when an object moves through an opening associated with at least one of the first position and the second position, wherein the opening is controlled by the barrier.

8. The method of claim 1, wherein the first position is a closed position, and the second position is an open position.

9. The method of claim 1, wherein the first position is a first open position, and the second position is a second open position.

10. The method of claim 1, further comprising:

determining, based at least in part on the hinge sensor, at least one of the first and second positions.

11. The method of claim 1, further comprising:

determining when the barrier changes position from the first position to the second position based at least in part on a sensor indication of the change in relative displacement of the rotatable portion in reference to the fixed portion.

12. A sensor assembly for use with a barrier, comprising:

a fixed portion configured to maintain a fixed position relative to a hinge of the barrier to which the sensor assembly is magnetically mounted; and a rotatable portion pivotally connected to the fixed portion and arranged to contact the barrier;

wherein the sensor assembly is operable to identify a first position of the barrier and determine a change in position of the barrier from the first position to a second position, wherein the change in position of the barrier is based on at least one of a relative position between the fixed and rotatable portions or a change in position of the rotatable portion relative to the fixed portion.

13. The sensor assembly of claim 12, further comprising:

a battery power source.

14. The sensor assembly of claim 12, further comprising:

a wireless transmitter configured to transmit data concerning the sensed position of the barrier.

15. The sensor assembly of claim 12, wherein the sensor assembly is operable to determine an amount the barrier is open relative to a closed position.

16. A barrier position detecting apparatus, comprising:

a mounting portion configured to magnetically mount a sensor assembly to a hinge of a barrier, wherein the configured magnetic mount is releasable;

a fixed portion configured to maintain a fixed position relative to the hinge;

a movable portion arranged to contact the barrier at least when the barrier moves, the movable portion being movable relative to the fixed portion; and a transmitter configured to wirelessly transfer data about at least one of a first position of the barrier and a change in position of the barrier from the first position to a second position, wherein the change in position of the barrier is based at least in part on one or more of a relative position between the fixed or movable portions and a change in position of the movable portion.

17. The apparatus of claim 16, wherein the movable portion is biased into contact with the barrier.

18. The apparatus of claim 16, further comprising:

at least one motion sensor, wherein the at least one motion sensor determine one or more of the change in position of the barrier from the first position to the second position and an object moving through an opening associated with the first position and the second position.

19. The apparatus of claim 18, wherein the at least one motion sensor comprises a passive infrared sensor.

20. The apparatus of claim 16, further comprising:

a potentiometer configured to determine a rotated position of the movable portion relative to the fixed portion.

21. The apparatus of claim 16, further comprising:

a piezoelectric sensor configured to measure an electrical charge generated from a force applied to the movable portion by the barrier when the barrier moves.

* * * * *